United States Patent [19]

Rizzoli et al.

[11] Patent Number: 5,076,290

[45] Date of Patent: Dec. 31, 1991

[54] FILTER-TIPPED CIGARETTE MANUFACTURING METHOD

[75] Inventors: Salvatore Rizzoli, Bologna; Bruno Belvederi, S. Martino di Monte S. Pietro, both of Italy

[73] Assignee: G.D. Societa' Per Azioni, Bologna, Italy

[21] Appl. No.: 619,008

[22] Filed: Nov. 28, 1990

[30] Foreign Application Priority Data

Dec. 7, 1989 [IT] Italy ..... 3754 A/89

[51] Int. Cl.[5] ..... A24C 5/47

[52] U.S. Cl. ..... 131/94

[58] Field of Search ..... 131/94

[56] References Cited

U.S. PATENT DOCUMENTS

| | | | |
|---|---|---|---|
| 3,245,414 | 4/1966 | Rudszinat | 131/94 |
| 3,303,926 | 7/1965 | Pohl . | |
| 3,308,833 | 3/1967 | Deaersley | 131/94 |
| 3,372,702 | 3/1968 | Bohn et al. | 131/94 |
| 4,200,179 | 4/1980 | Hinz . | |
| 4,336,812 | 6/1982 | Seragnoli . | |
| 4,368,743 | 1/1983 | Barbe et al. | 131/94 X |
| 4,577,644 | 3/1986 | Grieben | 131/94 |
| 4,886,077 | 12/1989 | Hinzmann et al. | 131/94 X |
| 4,913,167 | 4/1990 | Riccardo | 131/94 |
| 4,913,170 | 4/1990 | Conti | 131/94 X |

FOREIGN PATENT DOCUMENTS

| | | | |
|---|---|---|---|
| 153500 | 10/1953 | Australia | 131/94 |
| 1200229 | 10/1986 | Italy . | |
| 1069722 | 5/1967 | United Kingdom | 131/94 |

*Primary Examiner*—Vincent Millin
*Assistant Examiner*—J. Doyle
*Attorney, Agent, or Firm*—Marshall, O'Toole Gerstein, Murray & Bicknell

[57] ABSTRACT

A method of manufacturing filter-tipped cigarettes, whereby a first and second series of cigarette portions, obtained by transversely cutting two continuous cigarette rods travelling axially at substantially constant speed, are fed by respective transfer members into respective seats on respective first and second receiving rollers arranged side by side and tangent to each other. The portions in the first series are fed on to the first receiving roller in an axially offset position in relation to that in which the portions of the second series are fed on to the second receiving roller, and are fed from the first to the second receiving roller so as to form, inside each seat on the second receiving roller, a pair of coaxial portions the facing ends of which define a gap. A double filter is inserted between the facing ends of the two coaxial portions; is connected to the two coaxial portions to produce a double cigarette; and is subsequently cut to divide the double cigarette into two cigarettes.

4 Claims, 2 Drawing Sheets

FILTER-TIPPED CIGARETTE MANUFACTURING METHOD

BACKGROUND OF THE INVENTION

The present invention relates to a method of manufacturing- filter-tipped cigarettes.

Known filter assembly machines are usually supplied by a cigarette manufacturing machine producing a single continuous cigarette rod travelling axially at substantially constant speed.

As it comes off the manufacturing machine, the continuous cigarette rod encounters a cutting head, usually a rotary type, by which it is usually cut into "double portions", i.e. portions twice as long as that which, when joined to the filter, go to form a normal filter-tipped cigarette. Once cut, the double portions, pushed from the rear by the continuous cigarette rod, continue travelling in said axial direction, and are picked up and transferred successively by a transfer member on to the input element of a filter assembly machine. As described and illustrated, for example, in U.S. Pat. No. 4,577,644, the filter assembly machine normally comprises a series of parael feed rollers, each having a number of peripheral seats for receiving a respective double and feeding it forward transversely in relation to its longitudinal axis.

As they are transferred from the manufacturing machine to the filter assembly machine, the double portions therefore undergo a 90° variation in travelling direction, which transfer is effected by a special transfer member of the type described and illustrated, for example, in U.S. Pat. No. 3,303,926.

As it is fed forward transversely on the filter assembly machine, each double portion is first cut in half, and the two coaxial portions so formed are fed to a parting unit by which they are parted axially- by a sufficient amount to accommodate a double filter, the opposite ends of which are joined to the respective portions to form a double cigarette. The double filter is then cut in half to form two filter-tipped cigarettes.

On known filter assembly machines of the aforementioned type, the parting unit constitutes a critical element in that at least one of the coaxial portions is displaced axially in relation to the other. This invariably involves subjecting each coaxial portion to an axial force which, due to the poor mechanical resistance and high travelling speed of the coaxial portions, cannot be applied directly without damaging them. As a result, known parting units, such as the one described and illustrated in U.S. Pat. No. 4,200,179, are relatively high-cost and so mechanically complex as so seriously impair any possibility-y of further increasing the operating speed of the filter assembly machine.

SUMMARY OF THE INVENTION

The aim of the present invention is to provide a filter-tipped cigarette manufacturing method enabling the parting unit to be dispenser with.

With this aim in view, according to the present invention, there is provided a method of manufacturing filter-tipped cigarettes, characterized by the fact that it comprises successive stages consisting in:

a) successively feeding, by means of respective transfer members, respective first and second cigarette portions, obtained by transversely cutting respective first and second continuous cigarette rods travelling axially at substantially constant speed, into respective first and second seats of respective first and second receiving rollers; each said first portion being fed by said respective transfer member into said first seat in a first position axially reaction to a second position wherein each said second portion is fed by said respective transfer member into said second seat;

b) transferring each said first portion from said first position inside said first seat into a third position inside said second seat and coaxial with a respective said second portion on said second position inside said second seat; said two coaxial portions being separated inside said second seat by a distance at least equal to the length of a double filler;

c) inserting a double filter between said two coaxial portions inside each said second seat;

d) joining said double filter to the adjacent ends of said two coaxial portions, so as to produce a double cigarette; and e) cutting each said double filter in half to divide each said double cigarette into two cigarettes.

Said first and second portions are preferably fed successively off a dual-rod cigarette manufacturing machine, for example, of the type described and illustrated in U.S. Pat. No. 4,336,812.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 2:
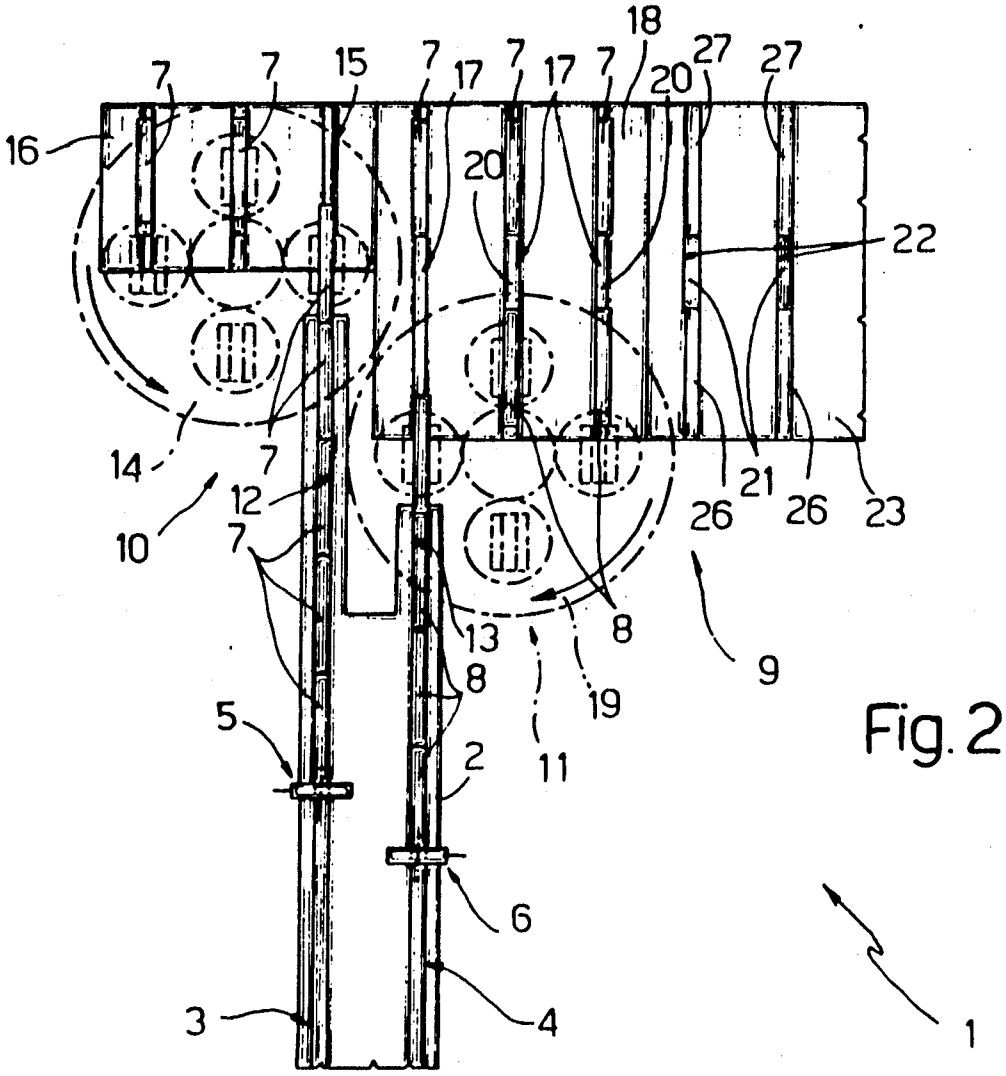
FIG.2 shows a plan view of a detail in FIG.1.

Number 1 in FIG.2 indicates a dual rod cigarette manufacturing machine of the type described and illustrated in U.S. Pat. No. 4,336,812, the content of which is referred to fully herein.

Machine 1 comprises an output plate 2 along which two continuous cigarette rods 3 and 4 are fed atthe same substantially constant axial speed, and are cut by respective known rotary cutting heads 5 and 6 into respective portions 7 and 8.

The speed of heads 5 and 6 is such as to produce portions 7 and 8 equal in length to the tobacco-filled portion of a single filter-tipped cigarette.

Figure 1:
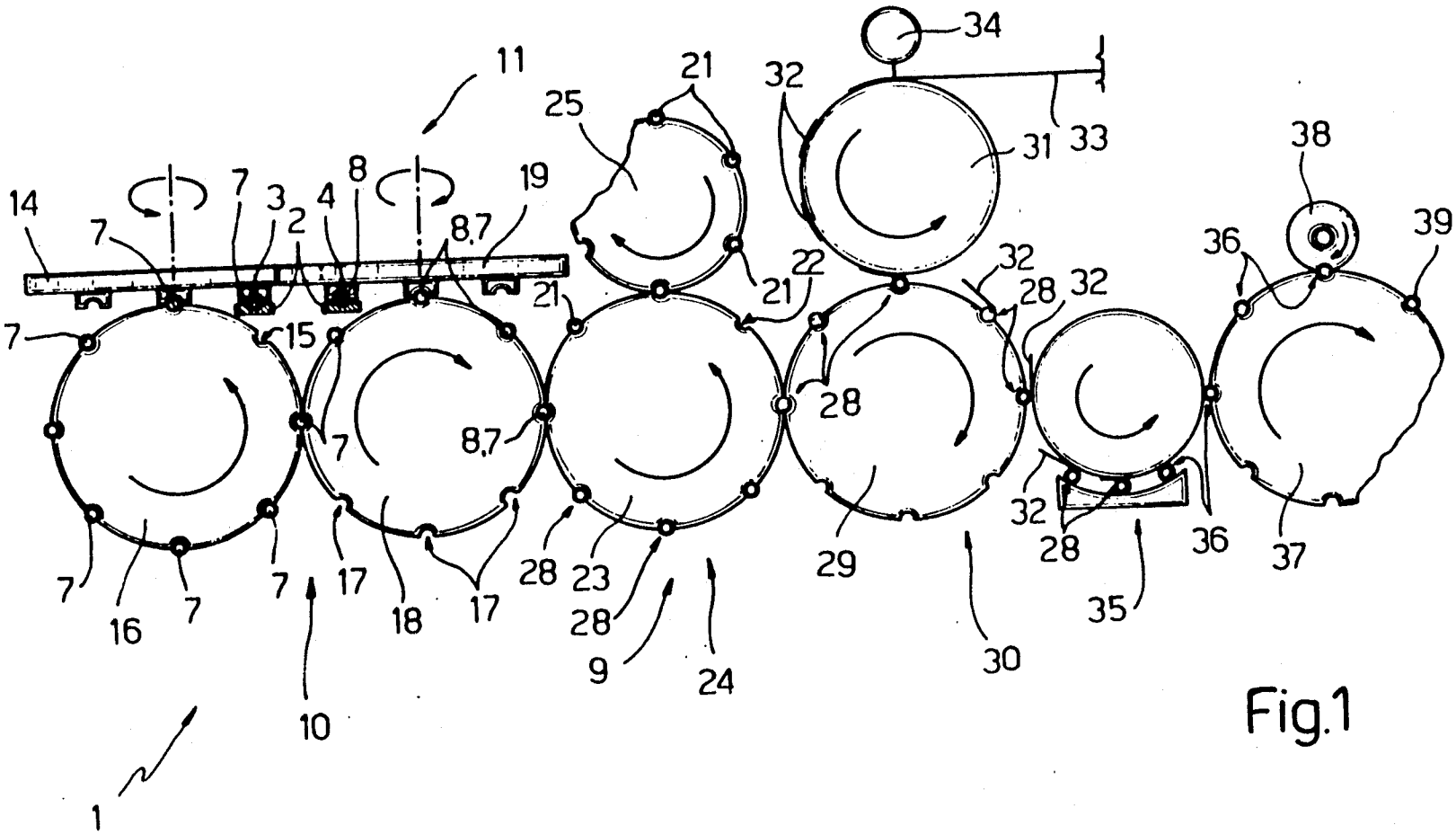
FIG.1 shows a partial, schematic view of a filter assembly machine connected to a dual-rod cigarette manufacturing machine implementing the method according to the present invention.

Number 9 in FIGS. 1 and 2 indicates a filter assembly machine, the input unit 10 of which is connected to output plate 2 of machine 1 by a transfer unit indicated as a whole by 11 and designed to successively transfer portions 7 and 8 from plate 2 to machine 9.

As shown in FIG.2, plate 2 comprises two side by side rails 12 and 13 for guiding rods 3 and 4 and respective portions 7 and 8 along respective straight paths. Rail 12 is longer than rail 13, and terminates beneath a first known rotary pickup unit 14 forming part of transfer unit 11 and of the type described, for example, in U.S. Pat. No. 3,303,926.

As it turns (anticlockwise in FIG.2) about is axis, preferably perpendicular to rail 12, unit 14 successively transfers portions 7 into respective seats 15 formed on the periphery of a first input roller 16 forming part of input unit 10 and powered so as to turn (anticlockwise in FIG.1) at speed about its axis parallel to rail 12. As it turns about its axis, roller 16 feeds portions 7 forward, transversely in relation to their longitudinal axis, and transfers them successively into respective seats 17 formed on the periphery of a second input roller 18 forming part of input unit 10 and powered so as to turn about its axis at the same speed as but in the opposite direction to roller 16.

As shown in FIG. 2, rollers 16 and 18 are parallel and substantially tangent to each other, and seats 17 are equally spaced about roller 18 with the same spacing as seats 15 on roller 16. Roller 18 and seats 17 are over twice as long as roller 16 and seats 15, and rollers 16 and 18 are so arranged that the axial ends opposite those facing machine 1 are substantially coplanar. When transferred from roller 16 to roller 18 (in known manner, usually by means of suction), each portion 7 therefore occupies a small portion of seat 17, in particular, the portion adjacent to the end of roller 18 opposite that facing machine 1.

As shown particularly in FIG.2, transfer unit 11 comprises a second rotary pickup unit 19 identical to unit 14 and offset in relation to the same, over the end of rail 13.

As it turns (clockwise in FIG.2) about is axis, preferably perpendicular to rail 13, unit 19 successively transfers portions 8 into respective seats 17. Due to the offset position of the free ends of rails 12 and 13 and the offset position of respective units 14 and 19, each portion 8, when transferred on to roller 18 (in known manner, usually by means of suction), occupies a small portion of respective seat 17, in particular the portion adjacent to the end of roller 18 facing machine 1.

In other words, each seat 17 is occupied by two coaxial portions 7 and 8 extending along opposite end portions of seat 17. The length of rails 12 and 13, the location of units 14 and 19 and the length of roller 18 are so selected that the facing ends of coaxial portions 7 and 8 define, along seat 17, an intermediate gap 20, the length of which is at least, and usually substantially, equal to that of a double filter 21, i.e. a filter twice the length of that of a single filter-tipped cigarette. Coaxial portions 7 and 8 are fed successively by roller 18 into respective seats 22 on a roller 23 substantially tangent to roller 18 and turning about its axis in the same direction as roller 16 and at the same speed as roller 18. Roller 23 is arranged parallel to rollers 16 and 18, and forms part of a known assembly unit 24 also comprising a roller 25 supplying double filters 21. As shown in FIG.1, roller 25 is arranged substantially tangent to roller 23, and turns about its axis at the same speed as but in the opposite direction to roller 23, so as to feed each double filter 21 into a central portion of seat 22 corresponding to the intermediate gap 20 in seats 17. When fed into respective seat 22, each double filter 21 therefore defines, inside seat 22, two empty portions 26 and 27, which are subsequently occupied by respective portions 7 and 8 transferred by roller 18, so as o form, on roller 23, a group 28 consisting of two coaxial portions 7 and 8 separated by a double filter 21.

Groups 28 are fed successively by roller 23 on to the input roller 29 of a finishing unit 30 of the type described and claimed in Italian Patent No. 1,200,229 the content of which is referred to fully herein.

As shown in FIG.1, in addition to roller 29, unit 30 also comprises a roller 31 for supplying strips 32 cut from a continuous strip 33 by a cutting unit 34, and each designed to join portions 7 and 8 and double filter 21 of each group 28. Unit 30 also comprises a rolling unit 35 for successively receiving groups 28 and respective strips 32 from roller 29; rolling each strip 32 about respective double filter 21 and the ends of portions 7 and 8 to produce a double cigarette 36; and successively feeding double cigarettes 36 on to an output roller 37. On roller 37, double cigarettes 36 are fed through a cutting unit 38 which cuts double filters 21, and consequently double cigarettes 36, in half to produce coaxial pairs of cigarettes 39 which are then fed by roller 37 to further units (not shown) on filter assembly machine 9.

Consequently, by supplying filter assembly machine 9 simultaneously and continuously with two series of portions 7 and 8, produced on a dual-rod manufacturing machine of the type described, or on two single-rod machines arranged side by side, and by supplying said two series in axially offset positions in relation to each other, the method described above -provides for obtaining directly, with no further handing required, pairs of coaxial portions 7 and 8 separated by a distance enabling insertion of a double filter 21.

We claim:

1. A method of manufacturing filter-tipped cigarettes comprises:

a) successively feeding, by means of respective transfer members (14, 19), respective first and second cigarette portions (7, 8), obtained by transversely cutting respective first and second continuous cigarette rods (3, 4) travelling axially at substantially constant speed. into respective first and second seats (15, 17) of respective first and second receiving rollers (16, 18); each said first portion (7) being fed by said respective transfer member (14) into said first seat (15) in a first position axially offset in relation to a second position wherein each said second portion (8) is fed by sail respective transfer member (19) into said second seat (17);

b) transferring each said first portion (7) from said first position inside said first seat (15) into a third position inside said second seat (17) and coaxial with a respective said second portion (8) in said second position inside said second seat (17); said two coaxial portions (7, 8) being separated inside said second seat (17) by a distance at least equal to the length of a double filter (21);

c) inserting a double filter (21) between said two coaxial portions (7, 8) inside each said second seat (17);

d) joining said double filter (21) to the adjacent ends of said two coaxial portions (7, 8), so as to produce a double cigarette (36); and e) cutting each said double filer (21) in half to divide each said double cigarette (36) into two cigarettes (39).

2. A method as claimed in claim 1, characterized by the fact that each said first portion (7) is transferred from said first to said third position as it travels transversely in relation to its longitudinal axis.

3. A method as claimed in claim 1, characterized by the fact that said two receiving rollers (16, 18) are parallel and tangent to each other, and are turned at the same speed and in opposite directions to each other; said first and second seats (15, 17) being equally spaced about the periphery of respective said first and second receiving rollers (16, 18); and said second seats (17) being at least equal in length to said double cigarette (36).

4. A method as claimed in claim 1, characterized by the fact that said first and second portions (7, 8) are picked off successively from the output end of a dual-rod cigarette manufacturing machine (1).

* * * * *